US005570524A

United States Patent [19]

Groat

[11] Patent Number: 5,570,524

[45] Date of Patent: Nov. 5, 1996

[54] SNOW REMOVAL APPARATUS HAVING A CHUTE TO DISPOSE OF SNOW

[76] Inventor: LeRoy Groat, 6937 Bugle Ct., Anchorage, Ak. 99507

[21] Appl. No.: 489,756

[22] Filed: Jun. 13, 1995

[51] Int. Cl.[6] ..... E01H 5/02

[52] U.S. Cl. ..... 37/285; 37/268

[58] Field of Search ..... 37/285, 268, 266, 37/270, 265, 264; 294/54.5

[56] References Cited

U.S. PATENT DOCUMENTS

| | | | |
|---|---|---|---|
| 2,603,892 | 7/1952 | Fischer | 37/285 X |
| 2,891,330 | 6/1959 | Murphy | 37/285 |
| 2,950,547 | 8/1960 | Murphy | 37/285 X |
| 3,091,790 | 6/1963 | Schroeder | 37/285 X |
| 3,218,738 | 11/1965 | Bowerman | 37/268 |
| 3,274,684 | 9/1966 | Marks | 37/266 X |
| 3,483,643 | 12/1969 | Wenzel | 294/54.5 X |
| 3,583,747 | 6/1971 | Lambert | 37/285 X |
| 3,773,375 | 11/1973 | Nehls | 294/54.5 X |
| 3,784,245 | 1/1974 | Koller | 294/54.5 X |
| 3,998,486 | 12/1976 | Mittelstadt | 37/285 |
| 4,024,654 | 5/1977 | Snyder | 37/268 |
| 4,070,771 | 1/1978 | Yakiwchuk | 37/285 |
| 4,185,403 | 1/1980 | Hardgrove | 37/285 X |
| 4,249,767 | 2/1981 | Andreasen | 294/54.5 X |
| 4,386,474 | 6/1983 | Mechavich et al. | 37/285 |
| 4,550,943 | 11/1985 | Mirto | 294/54.5 |
| 4,669,206 | 6/1987 | Yost | 37/285 |
| 4,729,199 | 3/1988 | Oller | 37/285 X |
| 4,848,819 | 7/1989 | Moorefield | 294/54.5 |
| 5,083,388 | 1/1992 | Cooley | 37/285 X |
| 5,465,510 | 11/1995 | Goodnough et al. | 37/285 |

*Primary Examiner*—Terry Lee Melius
*Assistant Examiner*—Victor Batson
*Attorney, Agent, or Firm*—Michael J. Tavella

[57] ABSTRACT

A snow removal system for roofs and vehicles. The first embodiment has a frame with thin, high sidewalls and a thin flat base, a cross brace and a curved handle. A long sheet of plastic tarp is attached to the base to direct blocks of cut snow down to the ground. A pair of foam berms are used to turn the tarp into a chute. The berms help keep the snow inside the sheeting, which speeds removal from the roof. A second embodiment, uses a modified snow pusher that has a flat base blade, a side wall, either an angled or curved back plate and a handle. A bermed tarp is attached to the open side edge of the base plate. The third embodiment is intended for cleaning vehicles. It has a U shaped channel and a plastic chute. As the device is moved over the car, the snow is quickly dumped off on the chute, leaving the vehicle clean.

13 Claims, 6 Drawing Sheets

SNOW REMOVAL APPARATUS HAVING A CHUTE TO DISPOSE OF SNOW

BACKGROUND OF THE INVENTION

Snow shovels existed since the first time people have had to move snow. The most popular styles of snow shovels were derived from grain shovels. They have large, rectangular, flat blades and a handle. They are designed to lift snow to remove it. In most cases they do a reasonable but laborious job of cleaning snow. Using standard shovels to clear roofs, however, is problematic. First, the roofing material may be damaged as the blade of a snow shovel is pushed down into the snow. Picking up and disposing snow is also difficult as there is a chance of falling from the roof. More modern shovels have been developed for cleaning that are basically scoops. These scoops are not lifted but pushed along. Although they are an improvement over the standard shovels, they still have problems with dumping snow and, like shovels, they have limited capacity to move large quantities of snow at a time.

Several devices have been developed to aid in removal of snow from roofs. Unlike shovels, these devices are used to move snow without lifting it or having to dump snow over the edge of a roof that could cause a fall. These devices fall into two groups. Examples of the first group are U.S. Pat. Nos. 3,483,643, 4,024,654, 2,603,892, 4,185,403, and 4,249,767. U.S. Pat. No. 3,483,643 is called a snow scraper. It has a flat blade that is hinged on a forked frame. A handle is attached to the frame. The device is slid upwards over snow on a roof. As it is pushed upwards, the blade lies flat on the surface of the snow. When the desired height on the roof is reached, the handle is pulled. This causes the blade to become stuck in the snow. Continued pulling forces the blade to open and extend perpendicular to the handle. At this point, any snow behind the blade will be pulled off the roof. This device has two main problems. First, if the user is trying to pull a lot of snow from the roof, the user needs a lot of strength to force the blade through the snow. Second, any snow that does come off of the roof falls on the user, perhaps causing injury. U.S. Pat. No. 4,024,654 is a cylindrical device that dragged over a roof from the ground. The same difficulties apply here. Wet, heavy snow or snow that has frozen to the roof cannot be pulled easily from the roof. Moreover, any snow that is pulled from the roof falls on the user if the user is not careful. The remainder of the patents in this group are similar to the first set. The user typically pulls snow from the roof by standing below the roof. U.S. Pat. No. 2,603,892, in a rather unusual design uses a rake like device that is operated from inside a building through a window. Although this device eliminates the possibility of being hit with the falling snow, it is a cumbersome device that appears limited in its range of operation.

Examples of the second group of devices are found in U.S. Pat. Nos. 3,998,486 and 5,083,388. U.S. Pat. No. 3,998,486 shows a device with a rectangular frame and wheels. A handle is attached at the top of this frame. A long sheet of plastic is attached to the lower portion of the frame, located between the wheels. U.S. Pat. No. 5,083,388 has a frame with two vertical portions and a lower portion connecting the vertical members. A roll of plastic sheeting is attached to the lower frame member. A handle is attached to the center of the top of the lower frame portion. Both devices are used in a similar manner. The frame is either pushed or pulled along a roof. The frame dislodges quantities of snow, which then contact the plastic sheeting. The sheeting is designed to extend downward, below the eves. When the snow hits the sheeting, the plastic's low coefficient of friction causes the snow to quickly slide down the plastic sheet off the roof. U.S. Pat. No. 5,083,388 has the ability to roll up the sheeting after use for storage. Although these designs are a significant improvement over the latter designs, the frames are not large enough for efficient snow removal. They are designed to be light weight, their size makes them difficult to move through deep snow without considerable effort. The frame of U.S. Pat. No. 3,998,486, for example, is tubular, which does not easily cut through hard packed snow. Similarly, even though the sides of U.S. Pat. No. 5,083,388 are thin which helps them cut through hard snow, the center member that carries the tarp roll hinders the snow removal. Moreover, in both designs, the handle is mounted too low for practical and efficient use. Such a low handle position causes the user to lean forward when pulling the device up a roof. The handle position also makes it difficult to operate the devices from the ground because of the pitch of the roof. Only by adding extra length to the handles can a good attack angle be achieved. It is possible that 30 to 50 feet of handle would have to be used to reach the full extent of certain roofs. Such a handle length is totally impractical. Thus, pulling either of these devices through hard packed snow is difficult and pushing them from the ground is equally impractical.

SUMMARY OF THE INVENTION

The present invention overcomes these difficulties. There are three embodiments of this device. The first embodiment uses a rectangular metal frame. The frame has thin high sidewalls and a thin flat base that connects the sidewalls. A cross brace is attached across the sidewalls to stiffen the design and to be used as a hand grip to help pull the device up a roof. A curved handle is attached to the top of the frame. This handle sits about 30–36 inches above the base. When pulling the device up a roof, this height is ideal as it permits the user to lean forward (up the roof) rather than downward (down roof) when pulling the device. A long sheet of plastic tarp is attached to the base. This tarp is used as a sheet to direct the blocks of cut snow down to the ground. Because of the coefficient of friction, the snow easily slides down the chutes. Although this basic design is similar to that of the second group discussed above, it has one significant improvement. A pair of foam berms are attached to the edges of the tarp. These foam berms turn the tarp from a sheet to a chute. The berms help keep the snow inside the sheeting, which speeds removal from the roof. This embodiment is designed to be worked from the roof, not the ground, eliminating the possibility of being struck from above by snow and ice.

The second embodiment, uses a modified snow pusher. This embodiment has a flat base blade, a side wall, formed on the up roof side of the device, and either an angled or curved back plate. A handle is attached to the back plate. A bermed tarp as in the first embodiment is attached to the open side edge of the base plate. This tarp is tapered, becoming wider towards the bottom. This tapering is needed because as the device is pushed, the tarp may have a tendency to curl. This embodiment is used by moving laterally along a roof. As the device cuts into the snow, a block is cut onto the blade. This block immediately slides into the chute and is dropped to the ground. In this manner an entire roof can be cleared quickly and easily.

The third embodiment is a smaller sized version of the second embodiment. This design is intended for cleaning vehicles. It also has a plastic chute attached. As the device is moved over the car, the snow is quickly dumped off on the chute, leaving the vehicle clean.

DETAILED DESCRIPTION OF THE INVENTION

Figure 1:
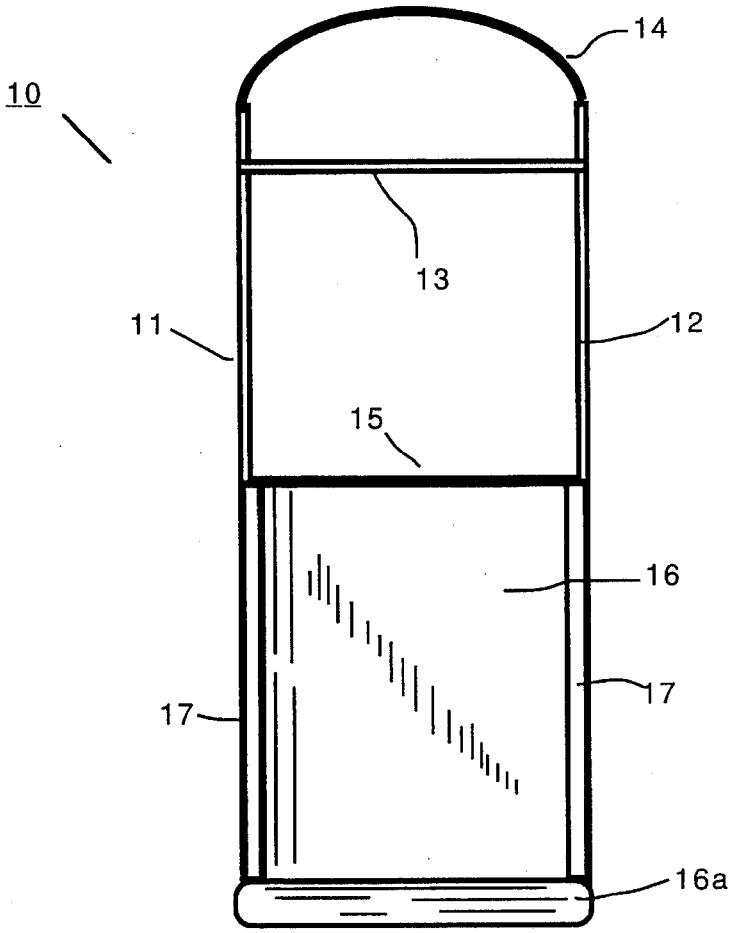
FIG. 1 is a front view of the first embodiment, with the chute being suspended below the device.
Figure 2:
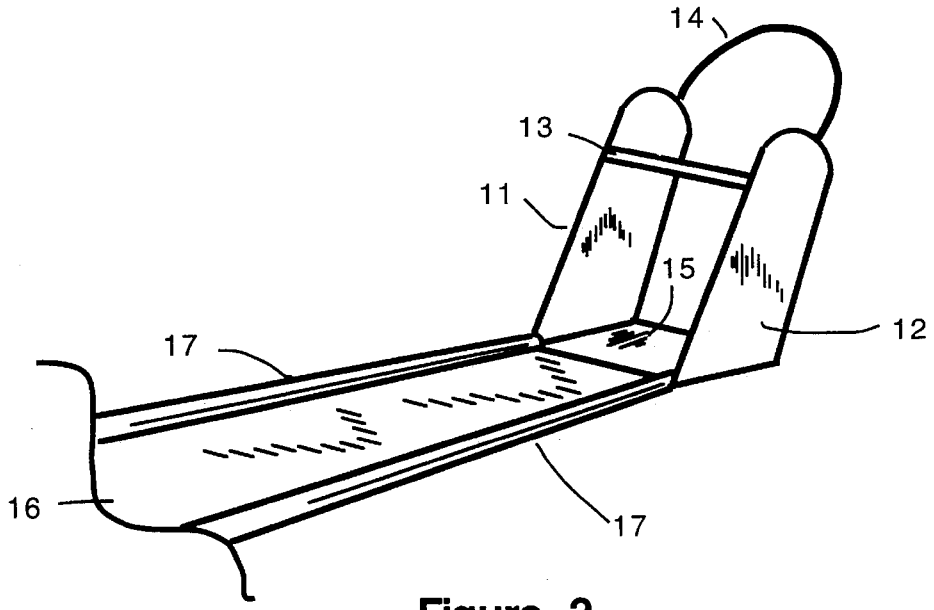
FIG. 2 is a perspective view of the first embodiment.

Referring now to FIGS. 1 and 2, the first embodiment has a frame 10 that has a pair of side members 11 and 12. The frame 10 also has a cross member 13 that may be used as a support handle for carrying the device or when pulling the device through the snow. A curved top handle 14 is also provided as shown. In the preferred embodiment, the curved top handle 14 is about 36 inches above the ground. This distance allows the user to pull the device without having to bend excessively, making the snow removal easier. A bottom plate 15 is provided to hold the frame 10 together and to provide a cutting edge. The bottom plate 15, and side members 11 and 12 are designed to be thin in the preferred embodiment to permit smooth cutting through heavy, packed snow.

Attached to the frame 10 is a tarp 16. In FIG. 1 the bottom of the tarp 16 is shown rolled as 16*a*. The tarp 16 acts as a chute to move snow quickly and easily away from the frame 10 (see FIG. 3). To better direct the moving snow, the tarp 16 has a pair of formed berms 17 that are attached to the tarp 16. See FIG. 4. The berms 17 are made of foam rubber and are held in the tarp 16 by rolling the edges of the tarp 16 as shown in FIG. 4.

Figure 3:
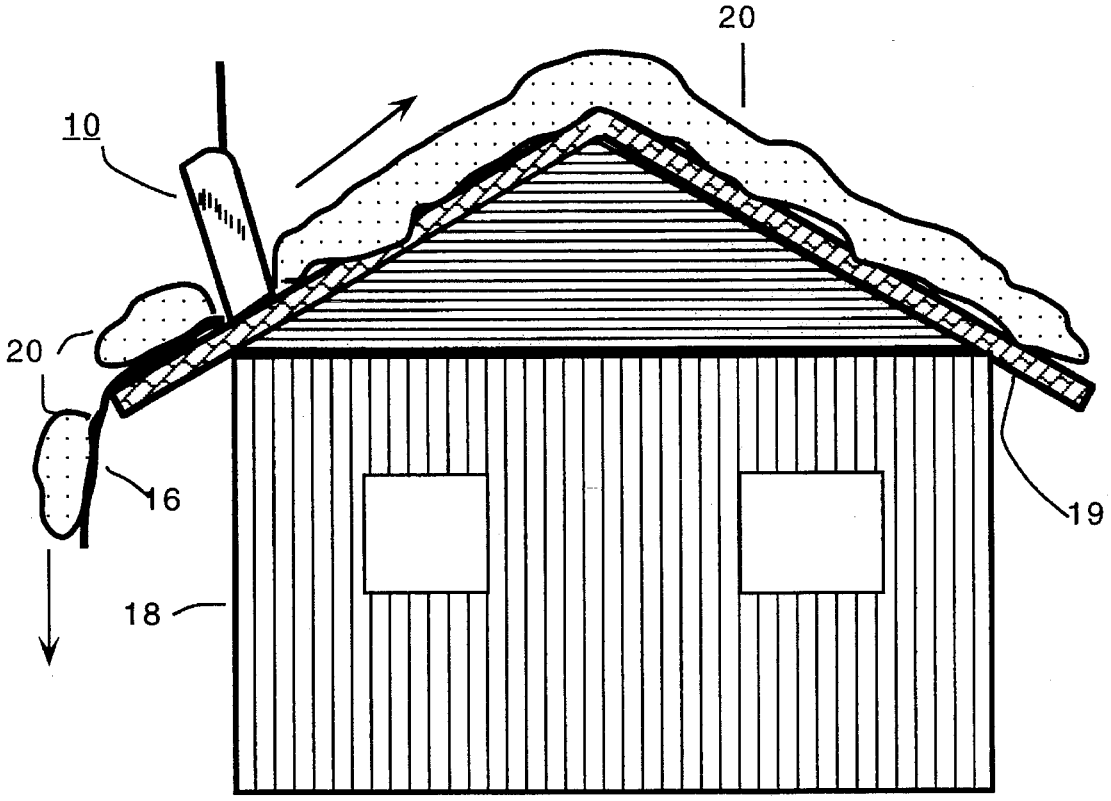
FIG. 3 is a representational view of the first embodiment on a typical roof, removing snow.
Figure 4:
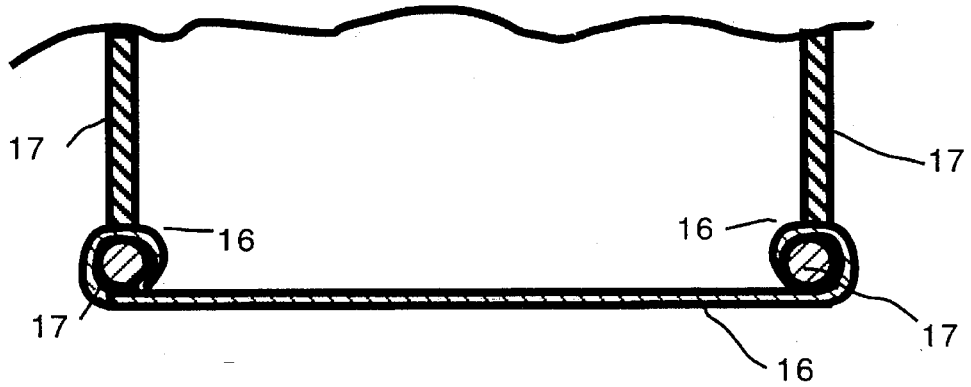
FIG. 4 is a cross-sectional view of the chute.

Referring now to FIG. 3, a typical house 18 is shown with a roof 19 and snow 20. The device 10 is shown on the roof 19. In the preferred embodiment, the device is pulled upwards on the roof 19. As the frame 10 is pulled, it cuts the snow 20 as shown. Packed snow can then fall, as blocks, down the chute 17 as shown. In this way, the roof 19 can be cleared quickly without risk of being struck by falling snow as is likely with roof cleaning devices that are operated from the ground.

Referring now to FIGS. 5–8, the second embodiment of the device is shown.

Figure 5:
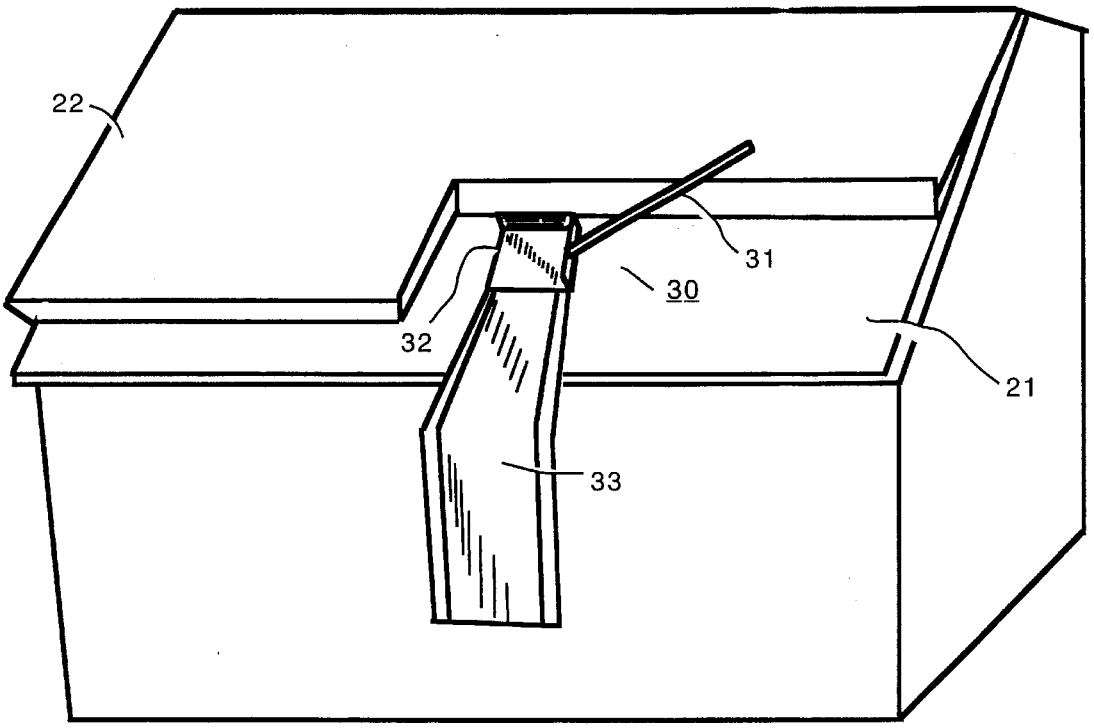
FIG. 5 a representational view of the second embodiment on a typical roof, removing snow.
Figure 6:
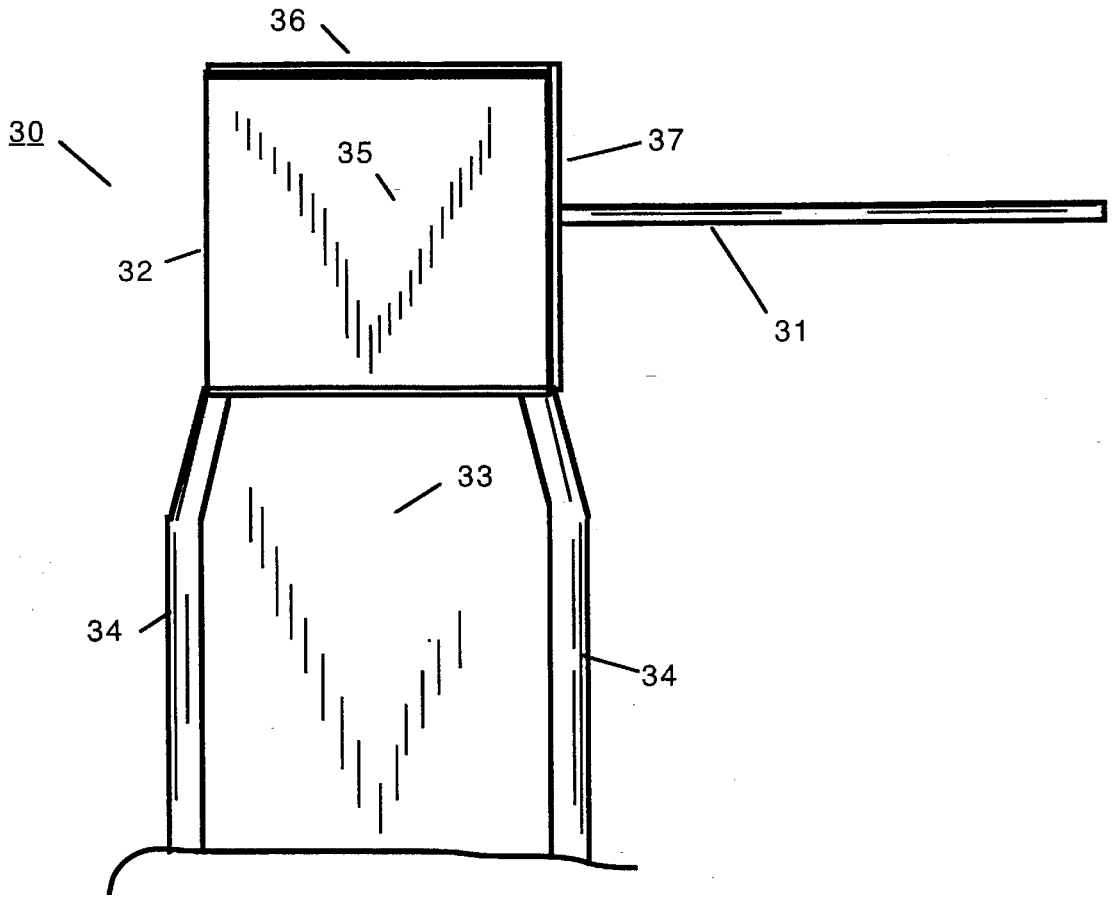
FIG. 6 is a top view of the second embodiment with an angled back plate.
Figure 7:
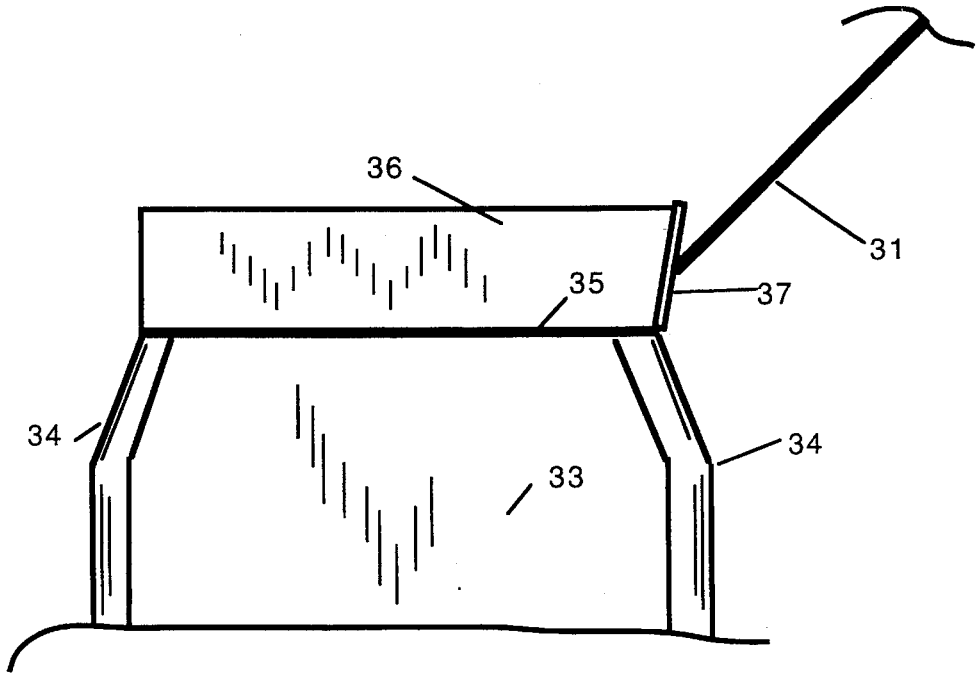
FIG. 7 is a side view of the second embodiment with an angled back plate.
Figure 8:
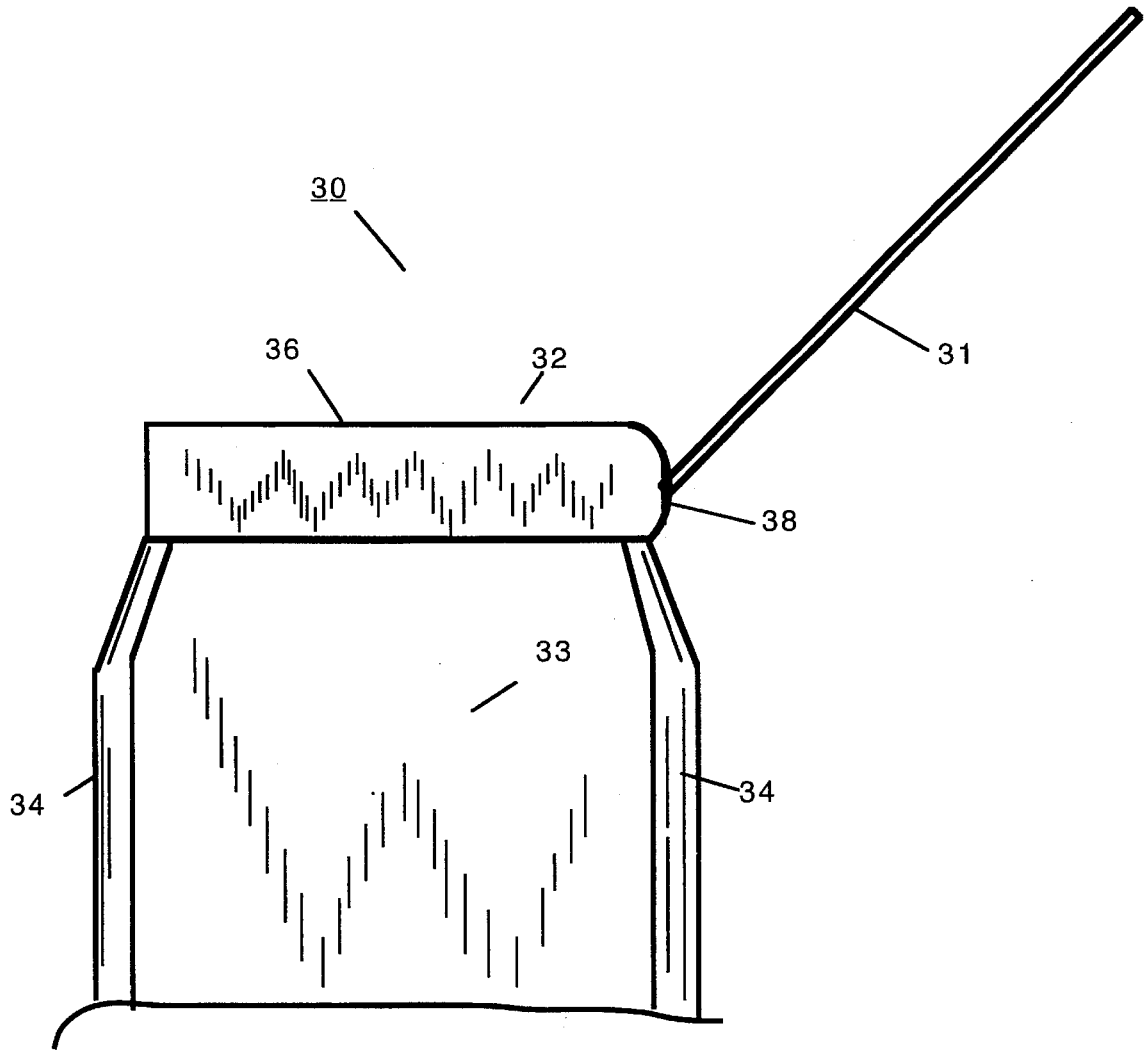
FIG. 8 is a side view of the second embodiment with a curved back plate.

This embodiment uses a shovel-like device 30 that cleans the roof 21 by moving laterally across the roof. FIG. 5 shows the snow remover 30 moving across a typical roof 21 with a quantity of snow 22 thereon. The snow remover 30 has a handle 31, a scoop 32 and a chute 33. Referring now to FIGS. 6, 7 and 8, details of the second embodiment are shown. The scoop 32 has a flat bottom 35 that is generally square, a side wall 36. The scoop 32 has two possible back plates. FIGS. 6 and 7 show an angled back plate 37. FIG. 8 shows a curved back plate 38. Both the angled back plate 37 and the curved back plate 38 are designed to receive the handle 31. The handle 31 can be attached using a bracket and screws, or any other common mounting method known in the art.

The chute 33 extends from the side of the device as shown. In this embodiment, the chute 33 is tapered outwardly, thus the chute 33 becomes wider as it extends from the scoop 32. The taper is required because the chute 33 has a tendency to drag when the scoop 32 is being pushed across a roof 21. Note that as in the first embodiment, the chute 33 has a pair of berms 34 attached to the edges of the chute 33 as shown. The berms 34 are attached in an identical manner as the berms of the first embodiment.

Referring now to FIG. 5, the scoop 32 is pushed laterally across a roof 21 as shown. Here, the snow 22 is forced into the scoop 32 until the scoop 32 is full. The side wall 36 cuts the snow 22 into a block the size of the scoop 32. This block of snow can then be slid onto the chute 33 where it is quickly dropped to the ground.

Figure 9:
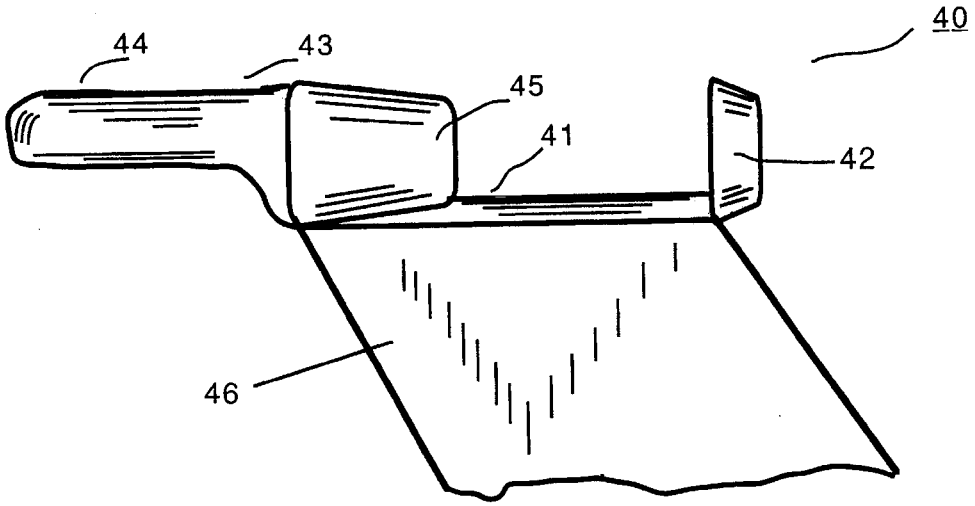
FIG. 9 is a perspective view of the third embodiment.
Figure 10:
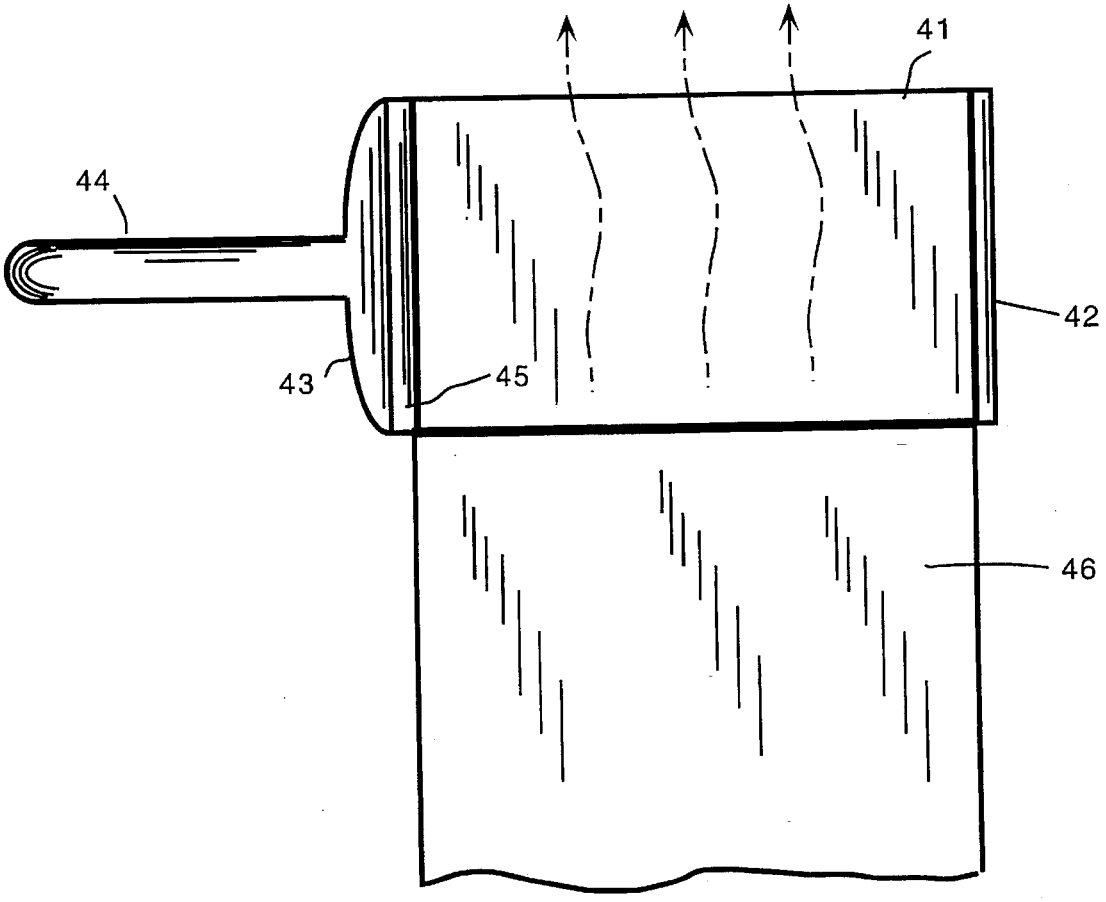
FIG. 10 is a top view of the third embodiment.

Referring now to FIGS. 9 and 10, a third embodiment 40 of the invention is disclosed. This embodiment is a smaller version that is intended for use on vehicles or small areas around buildings. This embodiment has a base plate 41, an outer side wall 42, and an end body 43. The end body 43 has a handle 44 integrally formed therein and a front face 45 as shown. As in the other embodiments, a chute 46 is attached to the base plate 41 as shown. The length of this chute 46 is approximately six feet.

This embodiment is used by pushing the device along the surface of a vehicle, for example in the direction of the arrows in FIG. 10. As snow is picked up, it slides from the vehicle on the chute 46. In this way, an entire vehicle can be cleaned quickly and easily.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A snow removal device for roofs comprising:

a) a thin, flat base plate, said base plate having a front and a back, a width and a pair of oppositely disposed sides;

b) a pair of thin sidewalls, fixedly attached to said base plate and extending upwardly therefrom for a height substantially greater than the width of said base plate, each side wall having a top;

c) a cross brace fixedly attached to the two thin sidewalls;

d) a curved handle fixedly attached to the top of said pair of side walls; and e) a long tarp, having a first side and a second side, being fixedly attached to the front of said base plate.

2. The snow removal device for roofs of claim 1 further comprising:

a pair of berms fixedly attached to the long tarp.

3. The snow removal device for roofs of claim 2 wherein the pair of berms comprise:

a) a first foam rubber cylinder, being fixedly attached to the first side of said long tarp;

b) means for covering said first foam rubber cylinder;

c) a second foam rubber cylinder, being fixedly attached to the second side of said long tarp; and b) means for covering said second foam rubber cylinder.

4. The snow removal device for roofs of claim 3 wherein the means for covering the first and second foam rubber cylinders comprises the first and second sides of said long tarp, being rolled over said first and second foam rubber cylinders and secured in place.

5. A snow removal device for roofs comprising:

a) a flat base blade, having a uproof side, a down roof side, a front and a back;

b) a side wall, fixedly attached to said flat base blade on the uproof side and extending upwardly from said flat base blade;

c) a back plate, fixedly attached to the back of the flat base blade and extending upwardly therefrom, said back plate being a rigid member;

d) a handle fixedly attached to the back plate; and e) a tarp having a first side and a second side, fixedly attached to the down roof side of said flat base blade, such that said tarp extends outwardly and downwardly from the downroof side of said flat base blade, and further such that said tarp does not extend onto said flat base blade, beyond the downroof side of said flat base blade, said tarp also being separate from said back plate.

6. The snow removal device for roofs of claim 5 wherein the tarp is tapered.

7. The snow removal device for roofs of claim 5 wherein the back plate extends upwardly from said base blade at an obtuse angle.

8. The snow removal device for roofs of claim 5 wherein the back plate is curved.

9. The snow removal device for roofs of claim 5 further comprising a pair of berms, being fixedly attached to said tarp.

10. The snow removal device for roofs of claim 5 wherein the pair of berms comprise:

a) a first foam rubber cylinder, being fixedly attached to the first side of said tarp;

b) means for covering said first foam rubber cylinder;

c) a second foam rubber cylinder, being fixedly attached to the second side of said tarp;

b) means for covering said second foam rubber cylinder.

11. The snow removal device for roofs of claim 10 wherein the means for covering the first and second foam rubber cylinders comprises the first and second sides of said tarp, being rolled over said first and second foam rubber cylinders and secured in place.

12. A snow removal device for vehicles comprising:

a) a flat, base plate, having a front, a back, a left side and a right side;

b) an outer side wall, being fixedly attached to the right side of said flat base plate and extending upwardly therefrom;

c) an inner side wall, being fixedly attached to the left side of said flat base plate, extending upwardly therefrom and being oppositely disposed from said outer side wall, thereby forming a channel between said outer wall and said inner wall such that the channel is open from the front to the back of said flat base plate; and d) a handle, being fixedly attached to said inner side wall and extending perpendicularly outward therefrom.

13. The snow removal device for vehicles of claim 12 further comprising; a tarp, fixedly attached to said base plate.

* * * * *